United States Patent [19]

Siffrin et al.

[11] Patent Number: 5,060,405

[45] Date of Patent: Oct. 29, 1991

[54] MATERIAL MOVING APPARATUS

[75] Inventors: Horst Siffrin, Merchweiler; Werner Michaely, Lebach, both of Fed. Rep. of Germany

[73] Assignee: Walter Becker GmbH, Friedrichsthal, Fed. Rep. of Germany

[21] Appl. No.: 356,266

[22] Filed: May 23, 1989

[30] Foreign Application Priority Data

Jun. 9, 1988 [DE] Fed. Rep. of Germany ..... 3819644

[51] Int. Cl.[5] ..... B61C 11/00; E02F 3/50

[52] U.S. Cl. ..... 37/117; 37/84; 37/106; 37/135; 299/67; 105/29.1; 105/150

[58] Field of Search ..... 37/115, 116, 117, 106, 37/135, 84; 299/67; 105/29.1, 148, 150

[56] References Cited

U.S. PATENT DOCUMENTS

| | | | |
|---|---|---|---|
| 701,593 | 6/1902 | Mahoney | 37/106 |
| 1,000,429 | 8/1911 | Moore | 105/148 |
| 1,902,691 | 3/1933 | Downie | 37/117 |
| 4,133,267 | 1/1979 | Farkas | 105/29.1 |
| 4,353,308 | 10/1982 | Brown | 105/29.1 X |

FOREIGN PATENT DOCUMENTS

| | | | |
|---|---|---|---|
| 2129251 | 8/1979 | Fed. Rep. of Germany | 37/117 |
| 1458602 | 2/1989 | U.S.S.R. | 37/DIG. 13 |

*Primary Examiner*—David H. Corbin
*Assistant Examiner*—Arlen L. Olsen
*Attorney, Agent, or Firm*—Peter K. Kontler

[57] ABSTRACT

A bucket loader wherein the bucket is pivotally mounted at one end of an arm. The other end of the arm is pivotably connected to the locomotive of a multiple-trolley train which is mounted for travel along an overhead monorail in a surface mine or in an underground excavation. The bucket can be tilted by two chains each of which is connected to a winch on a discrete trolley of the train.

20 Claims, 1 Drawing Sheet

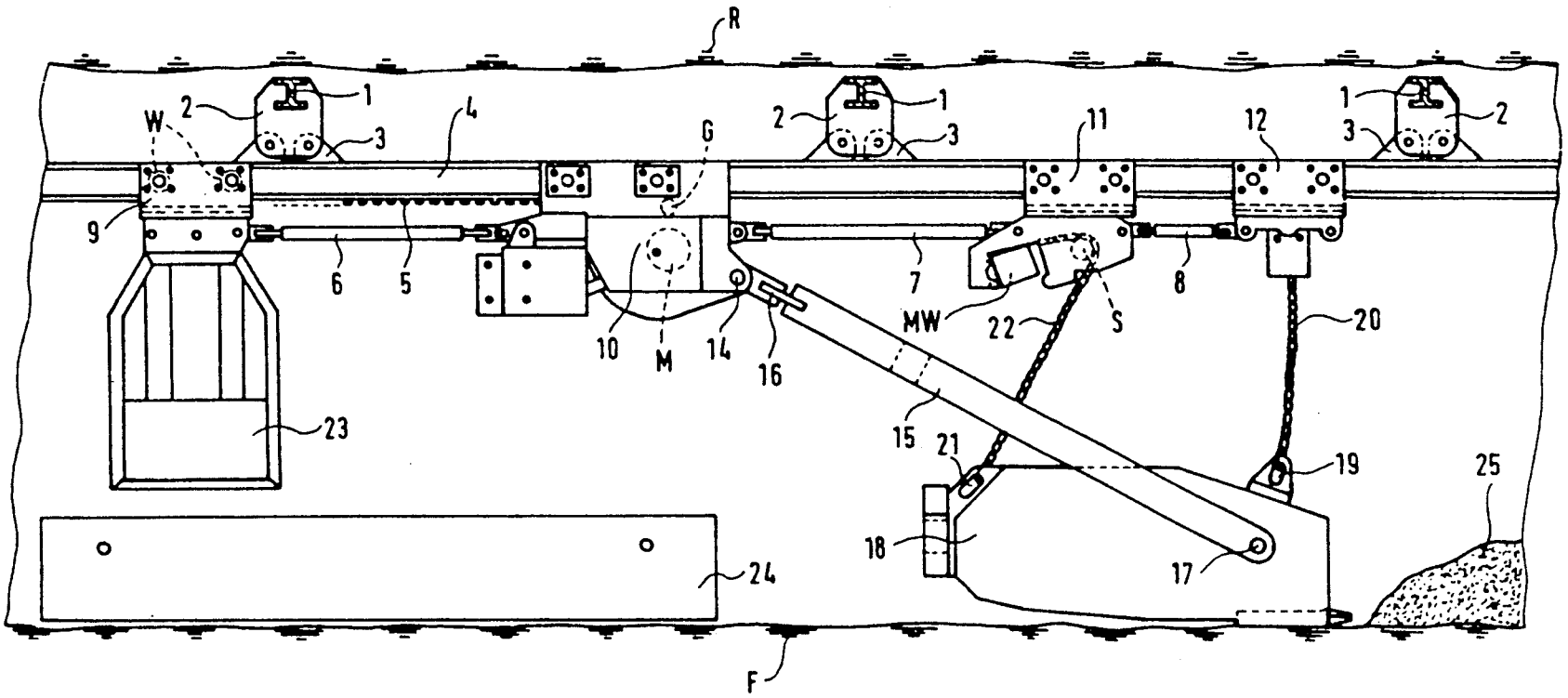
R
F
1
2
3
4
5
6
7
8
9
10
11
12
14
15
16
17
18
19
20
21
22
23
24
25
W
G
M
S
MW

MATERIAL MOVING APPARATUS

BACKGROUND OF THE INVENTION

The invention relates to improvements in material moving apparatus, particularly for use in surface or underground mining. Apparatus of the type to which the present invention pertains can be classified with bucket loaders, bulldozers and like machines. More particularly, the invention relates to improvements in apparatus wherein a conveyance carries a supporting member for an implement, such as a bucket, and the implement can be moved between different levels.

Bucket loaders of conventional design employ wheeled or track laying vehicles for buckets which must be turned or lifted to a level well above the ground or floor in order to transfer the accumulated material onto the platform of a truck or onto a conveyor. This can present problems, especially in underground excavations with little room for trucks and/or conveyors. Moreover, much time is lost for lifting of a filled bucket well above the floor or ground level and for returning the emptied bucket to its operative position, e.g., to a level at which the bucket is ready to scrape comminuted material off the floor in an underground excavation or off the ground in a surface mine.

OBJECTS OF THE INVENTION

An object of the invention is to provide a material moving apparatus which is simpler, more versatile and more efficient than heretofore known apparatus.

Another object of the invention is to provide a novel and improved bucket loader.

A further object of the invention is to provide a novel and improved mounting for the material moving, loosening and/or gathering implement of a bucket loader or a like apparatus.

An additional object of the invention is to provide the apparatus with novel and improved means for raising and lowering the material moving, gathering and/or loosening implement.

Still another object of the invention is to provide the apparatus with novel and improved means for moving the implement above or below the ground.

An additional object of the invention is to provide the apparatus with novel and improved means for evacuating the contents of a bucket or a like implement.

Another object of the invention is to provide a novel and improved method of transporting buckets and like implements in surface mining or in underground excavations.

A further object of he invention is to provide novel and improved means for preventing jamming of the conveyance for the implement.

SUMMARY OF THE INVENTION

The invention is embodied in a material moving apparatus, particularly for use in excavations. The improved apparatus comprises an elongated overhead track (e.g., a monorail), a conveyance which is mounted for movement along the track, and an attachment including a supporting member, connecting means including means for pivotally securing the supporting member to the conveyance for movement about a substantially horizontal axis extending substantially transversely of the track, an an implement mounted on the supporting member at a level below the conveyance. The apparatus preferably further comprises pivot means defining an axis which is substantially parallel to the horizontal axis and serving to connect the implement to the supporting member at a location which is preferably remote from the horizontal axis. The implement can include or constitute a bucket.

The conveyance can be assembled of several sections which are disposed one behind the other in the longitudinal direction of the track. The securing means is preferably mounted on one of the sections and the connecting means preferably further includes at least one additional means for securing the attachment to the conveyance. Such at least one additional securing means is preferably mounted on at least one other section of the conveyance. The conveyance can include or constitute a train having a plurality of cars each of which includes or constitutes one of the aforementioned sections. The train can further include distancing means between at least two of its cars.

The supporting member can include an elongated arm a first end portion of which is connected to a first section of the conveyance by the aforementioned securing means and a second end portion of which is articulately connected to the implement by the aforementioned pivot means. The additional securing means can include one or more chains or like flexible elements which connect the arm to at least one section other than the first section of the conveyance for movement of the second end portion of the arm between different levels. Such movements of the second end portion of the arm are shared by a portion at least of the implement. The additional securing means can be indirectly attached to the arm by way of the implement. If the implement is a bucket, the additional securing means can include a first means for moving the bucket up and down in the region of its open end and a second means for moving the bucket up and down in the region of its closed end independently of the first moving means. Each of the moving means can include a chain and a winch or the like for lowering or raising the respective end of the bucket by way of the chain. The pivot means preferably connects the second end portion of the arm with the bucket in the region of the open end of the bucket.

If the bucket is arranged to scrape material off the floor, e.g.. in a surface mine or in an underground excavation, the arm and the track preferably make an acute angle, particularly an angle of between approximately 30 and 40 degrees, while the bucket scrapes material off the floor.

If the conveyance is a train with several cars, the securing means is preferably designed to connect the first end portion of the arm to that car which constitutes the locomotive of the train. A car can constitute a driver's car, and the driver's car may but need not constitute the locomotive. The arrangement may be such that the locomotive is disposed between the driver's car and another car of the train.

The track can be provided with at least one toothed rack, and the conveyance then includes at least one driven gear which mates with the rack.

It is also within the purview of the invention to provide the track with at least one portion which is shiftable sideways from the conveyance, with or without a portion of the conveyance, to permit lateral shifting of the implement. If the apparatus is used in an underground excavation, it preferably further comprises means for suspending the track at the underside of the roof of such excavation.

The arm can include two portions and means for articulately connecting the two portions to each other for movement about an axis which is normal to the horizontal axis. This reduces the likelihood of jamming of the conveyance on the track while the implement scrapes material off the ground in a surface mine or off the floor in an underground excavation.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

THE BRIEF DESCRIPTION OF THE DRAWING

The single FIGURE of the drawing is a longitudinal vertical sectional view of an underground excavation with an apparatus having a conveyance in the form of a four-car train and an implement in the form of a bucket which is shown in a position ready to scrape comminuted material off the floor.

DESCRIPTION OF PREFERRED EMBODIMENTS

The drawing shows a portion of an underground excavation having a floor F and a roof R. The floor F supports a supply 25 of comminuted material (e.g., ore) which is to be transferred into a collecting receptacle 24. A filled receptacle 24 is removed from the excavation to be relieved of its contents and returned into the excavation or to be replaced with another (empty) receptacle.

The improved apparatus includes an elongated track 4 which is suspended in the excavation, close to or directly adjacent the roof R, on a series of transversely extending I-beams 1. The end portions of such beams can be anchored in the material of sidewalls adjacent the roof R. In addition to or in lieu of such anchoring of the end portions of the beams 1, these beams can be suspended from the roof R by suitable anchoring means of the type customarily employed in underground excavations. The track 4 is suspended from the beams 1 by pairs of brackets 2 and 3. The illustrated track 4 is assembled of two U-shaped profiles having vertical webs which are separated from each other by a toothed rack 5.

The track 4 movably supports an elongated conveyance in the form of a train having four sections or cars 9, 10, 11 and 12 which are separably coupled to each other by distancing elements including links 6, 7 and 8. Each section of the train has at least two wheels W which can roll along the lower legs of the U-shaped profiles of the track 4 in a direction to the left or to the right, as seen in the drawing. The section or car 10 is the locomotive of the train; it carries a reversible electric motor M to drive a gear G which meshes with the toothed rack 5 of the track 4.

The apparatus further comprises an attachment which is suspended from the train and includes an elongated supporting member in the form of a forked arm 15 having one of its end portions pivotally secured to the locomotive 10 by a substantially horizontal shaft 14 extending transversely of the longitudinal direction of the track 4 and its other end portion articulately connected to the open front end of an implement 18 in the form of an elongated bucket. The illustrated arm 15 includes a short portion which is connected to the shaft 14, a long portion which is connected to the shaft 17, and a joint 16 which articulately connects the two portions to each other in such a way that the longer portion can turn about an axis which is disposed at right angles to the horizontal axis of the shaft 14. This ensures that the long portion of the arm 15 can swivel with reference to the short portion to thus reduce the likelihood of jamming of the gear G against the rack 5 when the bucket 18 is caused to slide along an uneven floor F or is in the process of gathering comminuted material which includes large, small and very large particles (e.g., large pieces of rock).

The means for securing the attachment including the arm 15 and the bucket 18 to the train includes two additional securing devices in the form of chains 20, 22 or analogous flexible elements which can move the respective ends of the bucket 18 up and down preparatory to movement of the train along the track 4 or for the purpose of evacuating the contents of the bucket. The lower end of the chain 20 is affixed to a lug 19 at the open front end of the bucket 18, and the upper end of this chain is trained over a sprocket wheel (not shown) on the car 12. The chain 20 can be pulled up or lowered by a suitable motor-driven winch (not shown) on the car 12. The lower end portion of the chain 22 is affixed to a lug 21 at the other (rear and normally closed) end of the bucket 18, and its upper end portion is trained over a sprocket wheel S on the car 11 and can be moved up and down by a motor-driven winch MW of any known design. The winch MW can move the rear end of the bucket 8 up or down independently of the winch for the chain 20 and vice versa.

The chains 20, 22 constitute means for indirectly connecting the arm 15 to the cars 11 and 12 through the medium of the bucket 18. The arm 15 will be caused to pivot about the horizontal axis of the shaft 14 whenever the chain 20 raises or lowers the open end of the bucket 18.

The leftmost car 9 of the train carries a cabin 23 for the driver or operator of the train, i.e., the section or car 9 can be said to constitute a driver's car. This car is disposed at one side and the car 11 is disposed at the other side of the locomotive 10. The cabin 23 can be replaced with a simple seat or any other facility which can support the operator of the train including the cars 9 to 12. It is clear that the number of cars can be reduced to less than four or increased to five or more. For example, the train can include on or more additional cars to the left of the car 9, and such additional car or cars can be provided with means for lifting the receptacle 24 off the floor F for transport out of the excavation and for subsequent reintroduction into the excavation for collection of material which is delivered by the bucket 18.

The operation of the improved apparatus is as follows:

The locomotive 10 is assumed to move the entire train and the bucket 18 in a direction to the right so that the bucket gathers some material of the supply 25. At such time, the arm 15 is maintained at an acute angle to the horizontal and to the track 4, preferably at an angle of 30 to 40 degrees. The bottom wall of the bucket 18 lies substantially flush against the floor F and automatically gathers comminuted material off the floor as the train advances to the right.

When the bucket 18 has accumulated a desired quantity of comminuted material, the chain 20 is caused to move the open end of the bucket upwardly which results in a counterclockwise pivotal movement of the arm 15. At the same time, or thereafter; the chain 22 is caused to lift the rear end of the filled bucket 18, preferably at a lesser rate than the lifting of the open end of the bucket. The pivoting arm 15 moves the entire bucket 18 to the right so that the chain 22 is vertical or nearly vertical when the open end of the bucket assumes a position at a level at least slightly above the other end. The chain 20 is then inclined to the vertical. When the rear end of the bucket 18 is disposed at a required distance above the floor F and at a level above the receptacle 24, the locomotive 10 causes the train to move in a direction to the left so that the open end of the bucket is located at a level above the receptacle. The evacuation of the contents of the bucket 18 is effected by lowering the open end by way of the chain 20 and by raising the other end by way of the chain 22 or by simply maintaining the other end at a level at least slightly above the level of the receptacle 24. When the evacuating step is completed, the train returns the bucket 18 to a position adjacent the supply 25 of comminuted material and the bucket is manipulated by the chains 20 and 22 to assume an optimum position for gathering of additional material. When the receptacle 24 is filled, the bucket 18 is lifted so that it can be advanced over the supply 25 of loose material and that the additional car or cars to the left of the driver's car 9 can be advanced above the receptacle. The latter is then lifted and transported out of the excavation.

It is possible to construct the track 4 in such a way that a portion of the track can be transferred sideways (toward or away from the observer of the drawing) so that the sections 10–12 can be moved onto the transferred portion of he tack and the bucket 18 can begin to remove material closer to the one or the other sidewall of the excavation. The transfer of a portion of the track 4 can be effected from the train. If the apparatus is designed for such conversion, the arm 15 is preferably mounted for pivotal movement in a direction which is necessary to shift the bucket 18 sideways. The aforedescribed joint 16 permits such pivoting of the arm 15. However, it is then preferred to interchange the positions of the shaft 14 and joint 16. The track 4 could be split in the regions of the median and right-hand beams 1 so that the track portion between these two beams can be pivoted in the region of the median beam to constitute a switch which can move the cars 11 and 12 sideways. The front end of such portion of the track 4 can slide along the right-hand beam 1. The same procedure can be repeated between the right-hand beam 1 and the next-following beam or between any other pair of beams.

An important advantage of the improved apparatus is that the attachment including the arm 15 and the implement 18 is not in the way of the train. Moreover, it is not necessary to pivot the implement over the train in order to evacuate its contents, even if the receptacle 24 or a conveyor for reception of gathered material is located behind the train. All that is necessary is to slightly lift the implement 18 above the floor F and to cause the locomotive to advance the train in a direction to locate the implement and its contents above the receptacle or above the conveyor. The manipulation is equally simple if the train is to advance above and beyond the supply 25 of comminuted material, i.e., the implement 18 is simply lifted to a level above the supply 25 and the train is free to proceed in a direction to the right.

An additional important advantage of the improved apparatus is that the gear G and the rack 5 can establish a reliable form-locking connection between the train and the track 4. This is in contrast to wheel-mounted or tack laying conveyances where the track and the wheels are in mere frictional engagement with the ground. Moreover, the wear upon a track or upon the wheels of a bucket loader or a like machine is very pronounced, especially when the track or the wheels must advance along uneven terrain or over a floor which is covered with sharp particles of comminuted rock or the like. Still further, the energy requirements of the locommotive 10 are small in comparison with the energy requirements of the engine of a track laying conveyance or a conveyance which is mounted on wheels, especially if the track or the wheels must advance along uneven terrain. In addition, it is much simpler and more convenient to supply electric current or compressed fluid to the locomotive 2 of a conveyance which is mounted for movement along an overhead track than to supply energy to wheel-mounted or track laying conveyances of heretofore known design. The speed of a conveyance which travels along an overhead track is incomparably higher than that of a wheel-mounted or track laying vehicle, especially if the vehicle is to travel on uneven terrain or on a layer of comminuted material.

It has been found that, when the improved apparatus is put to use in an underground excavation or in a surface mine, e.g., in a gold mine, to transport removed material through distances of up to 90 to 100 meters, the improved apparatus (if necessary in conjunction with a second apparatus) can increase the rate of material removal by up to and more than five times when compared with the output of heretofore known buckets on wheel-mounted or track laying conveyances.

The apparatus of the present invention can be put to use in many other fields, i.e., not exclusively in mining. For example, the apparatus can be used to eliminate unevennesses of the floor or ground, the implement can include a milling tool which cuts the material beneath the conveyance, the implement can include a drill or the implement can include a ripping hammer.

An additional important advantage of the improved apparatus is that the bucket 18 or another implement can be suspended from the train at several spaced-apart locations. This renders it possible to employ a much larger bucket because the bucket can be reliably supported by several discrete cars of the train. In heretofore known bucket loaders which employ wheel-mounted or track laying conveyances, the bucket is invariably mounted only at the free end of the supporting arm.

The length of the links 6 to 8 can be increased or reduced, depending upon the desired distances between neighboring cars of the train. Thus, it is possible to change the mutual spacing of those cars (10, 11 and 12) which carry the arm 15 and the bucket 18. Each link can be assembled of several sections so that its length can be varied within a desired range.

The chain 20 and/or 22 can be replaced with a long fluid-operated motor without departing from the spirit of the invention. Furthermore, the means for tilting the bucket 18 can be connected with the bucket by way of the arm 15. The illustrated construction, wherein the chains 20, 22 serve to directly connect the bucket 18 with the sections or cars 11 and 12, is preferred at this time because the flow of power takes place directly between the bucket and the conveyance. The entire weight of the bucket 18 is carried directly by the train rather than by the arm 15. The latter is merely required to transmit forces when the bucket 18 is caused to scrape material off the floor F. The placing of the connection (shaft 17) between the arm 15 and the bucket 18 close to the open end of the bucket is desirable and advantageous because this ensures that the bucket is not subjected to pronounced torsional stresses when it must gather material off the floor F.

While it is possible to pivotally connect the arm 15 to the car 9, 11 or 12 of the illustrated train it is presently preferred to establish such connection between the arm and the locomotive 10. This ensures that the horizontal component of the force which develops when the train advances to the right and the bucket 18 slides along the floor F is transmitted directly to that car of the train which is in positive engagement with the track 4.

The aforediscussed selection of an angle of approximately 30 to 40 degrees between the arm 15 and the track 4 is preferred at this time because this renders it possible to reduce the overall length of the apparatus. Moreover, the arm 15 is prevented from transmitting to the train a very large force from below when the bucket 18 is in the process of scraping material off the floor.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Material moving apparatus, particularly for use in excavations, comprising an elongated fixed overhead track; a motor-driven conveyance suspended on and mounted for movement along said track; and an attachment including a supporting member, connecting means including means for pivotally securing said supporting member to said conveyance for movement about a substantially horizontal axis extending substantially transversely of said track, and an earth-working implement secured to said supporting member at a level below said conveyance.

2. The apparatus of claim 1, further comprising pivot means defining an axis which is substantially parallel to said horizontal axis, said pivot means connecting said implement to said supporting member and being remote from said horizontal axis.

3. The apparatus of claim 2, wherein said conveyance includes a plurality of sections disposed one after the other in the longitudinal direction of said track and said supporting member includes an elongated arm having a first end portion connected to a first section of said conveyance by said securing means and a second end portion connected with said implement by said pivot means, said connecting means further comprising additional means for securing said arm to a second section of said conveyance for movement of said second end portion between different levels.

4. The apparatus of claim 3, wherein said implement includes a bucket and said additional securing means is affixed to said bucket.

5. The apparatus of claim 4, wherein said bucket includes an open end and a second end, said additional securing means including first means for moving said bucket up and down in the region of said open end and second means for moving said bucket up and down in the region of said second end independently of said first moving means.

6. The apparatus of claim 5, wherein said pivot means connects said arm with said bucket in the region of said open end.

7. The apparatus of claim 4, wherein said bucket is arranged to scrape material off the floor or ground beneath said conveyance and said arm is inclined with reference to said track at an acute angle while the bucket scrapes material.

8. The apparatus of claim 7, wherein said angle is between approximately 30 and 40 degrees.

9. The apparatus of claim 1, wherein said implement includes a bucket.

10. The apparatus of claim 1, wherein said conveyance includes a plurality of sections disposed one behind the other in the longitudinal direction of said track, said securing means being mounted on one of said sections and said connecting means including at least one additional means for securing said attachment to said conveyance, said at least one additional securing means being mounted on another of said sections.

11. The apparatus of claim 10, wherein said conveyance includes a train having a plurality of cars each of which constitutes one of said sections.

12. The apparatus of claim 11, wherein said train further comprises distancing means between at least two of said cars.

13. The apparatus of claim 1, wherein said conveyance includes a train having a plurality of cars including a locomotive, said securing means including means for connecting said supporting member to said locomotive.

14. The apparatus of claim 1, wherein said conveyance includes a train comprising a plurality of cars including a driver's car.

15. The apparatus of claim 1, wherein said track includes a toothed rack and said conveyance includes at least one driven gear mating with said rack.

16. The apparatus of claim 1, wherein said track includes a portion which is shiftable sideways with or without at least a portion of said conveyance.

17. The apparatus of claim 1, wherein said track is a monorail.

18. The apparatus of claim 1, further comprising means for suspending said track at the underside of the roof of an underground excavation.

19. The apparatus of claim 1, wherein said supporting member includes two portions and means for articulately connecting said portions to each other for movement about a second axis which is normal to said horizontal axis.

20. The apparatus of claim 1, wherein said conveyance includes a train having a plurality of cars including a locomotive, a driver's car and at least one additional car, said locomotive being disposed between said driver's car and said at least one additional car.

* * * * *